United States Patent [19]

Naik et al.

[11] Patent Number: 4,732,707

[45] Date of Patent: Mar. 22, 1988

[54] DETERGENT COMPOSITIONS CONTAINING SPECIAL ALKYL ETHER SULPHATE IN COMBINATION WITH ALKYLBENZENE SULPHONATE AND/OR DIALKYL SULPHOSUCCINATE ESTERS

[75] Inventors: Appaya R. Naik, Birkenhead, England; Francesco M. Orlandini, Codogno, Italy

[73] Assignee: Lever Brothers Company, New York, N.Y.

[21] Appl. No.: 14,137

[22] Filed: Jan. 30, 1987

Related U.S. Application Data

[63] Continuation-in-part of Ser. No. 764,169, Aug. 9, 1985, abandoned.

[30] Foreign Application Priority Data

Aug. 17, 1984 [GB] United Kingdom ..... 8420945

[51] Int. Cl.[4] ..... C11D 1/29; C11D 1/75

[52] U.S. Cl. ..... 252/548; 252/550; 252/551; 252/552; 252/553; 252/557; 252/558; 252/559; 252/DIG. 14

[58] Field of Search ..... 252/550, 551, 552, 553, 252/557, 558, 559, DIG. 14

[56] References Cited

U.S. PATENT DOCUMENTS

| | | | |
|---|---|---|---|
| 4,075,129 | 2/1978 | Murata et al. | 252/527 |
| 4,435,317 | 3/1984 | Gerritsen et al. | 252/547 |
| 4,537,709 | 8/1985 | Edge et al. | 252/558 |
| 4,549,984 | 10/1985 | Satsuki et al. | 252/532 |
| 4,554,098 | 11/1985 | Klisch et al. | 252/547 |

FOREIGN PATENT DOCUMENTS

| | | |
|---|---|---|
| 71413 | 2/1983 | European Pat. Off. . |
| 71414 | 2/1983 | European Pat. Off. . |
| 36107 | 3/1977 | Japan . |
| 86707 | 7/1978 | Japan . |
| 187498 | 11/1983 | Japan . |
| 738538 | 10/1955 | United Kingdom . |
| 1068528 | 5/1967 | United Kingdom . |
| 1429637 | 3/1976 | United Kingdom . |
| 1504843 | 3/1978 | United Kingdom . |
| 1518807 | 7/1978 | United Kingdom . |
| 2010892 | 7/1979 | United Kingdom . |
| 2104913 | 3/1983 | United Kingdom . |
| 2105325 | 3/1983 | United Kingdom . |
| 2108520 | 5/1983 | United Kingdom . |
| 2130235 | 5/1984 | United Kingdom . |
| 2130238 | 5/1984 | United Kingdom . |
| 2130234 | 5/1984 | United Kingdom . |
| 2130236 | 5/1984 | United Kingdom . |

*Primary Examiner*—Prince E. Willis

*Attorney, Agent, or Firm*—Milton L. Honig; James J. Farrell

[57] ABSTRACT

Alkyl ether sulphates are disclosed that are derived substantially wholly from $C_{12}$ and $C_{13}$ alcohols, at least 50% by weight being branched at the 2-position and at least 30% by weight being 2-ethyl or more highly branched. Foaming detergent compositions containing an alkylbenzene sulphonate and/or a dialkyl sulphosuccinate in combination with an alkyl ether sulphate of this specific type exhibit excellent foaming and detergency and are especially suitable for hand dishwashing.

9 Claims, No Drawings

DETERGENT COMPOSITIONS CONTAINING SPECIAL ALKYL ETHER SULPHATE IN COMBINATION WITH ALKYLBENZENE SULPHONATE AND/OR DIALKYL SULPHOSUCCINATE ESTERS

This is a continuation-in-part of application Ser. No. 764,169, filed Aug. 9, 1985, now abandoned.

The present invention relates to foaming detergent compositions containing alkyl ether sulphates based on a specific aliphatic $C_{10}$–$C_{20}$ carbon chain. The invention is especially concerned with light-duty liquid compositions intended to produce copious foam, for example, dishwashing liquids and shampoos.

The foaming detergent compositions of the present invention, which may take any suitable physical form, contain from 2 to 95% by weight of an active detergent system comprising (a) a linear $C_8$–$C_{14}$ alkylbenzene sulphonate and/or a $C_4$–$C_{10}$ dialkyl sulphosuccinate, and (b) an alkyl ether sulphate of the formula I $$R_1—O—(CH_2CH_2O)_n—SO_3X_1 \quad (I)$$

wherein $R_1$ is a $C_{10}$–$C_{20}$ alkyl group, the average degree of ethoxylation n is from 2 to 12 and $X_1$ is a solubilising cation, the alkyl ether sulphate of the formula I containing at most 20% of material in which the group $R_1$ contains 14 or more carbon atoms, consisting to an extent of at least 50% by weight of material in which the group $R_1$ is branched at the 2-position, and consisting to an extent of at least 30% by weight of material in which the group $R_1$ carries at the 2-position an alkyl group containing 2 or more carbon atoms, the weight ratio of (a) to (b) being within the range of from 3:1 to 0.5:1.

In the formula I, the solubilising cation $X_1$ is any cation yielding a salt sufficiently soluble to be detergent-active: it will generally be monovalent, for example, alkali metal, especially sodium; ammonium; or substituted ammonium, for example, ethanolamine. Certain divalent cations, notably magnesium, are however also suitable.

Dishwashing liquids containing an alkylbenzene sulphonate and an alkyl ether sulphate are well known and have been widely disclosed in the art, for example, in GB No. 1 068 528 (Colgate-Palmolive) and GB No. 2 010 892B (Unilever). Dishwashing liquids containing dialkyl sulphosuccinates together with alkyl ether sulphates were first disclosed in GB No. 1 429 637 (Unilever). GB No. 2 108 520, GB No. 2 104 213, GB No. 2 105 325, EP No. 71 413 and EP No. 71 414 also dislcose this combination of detergent-active materials. GB No. 2 130 235A (Unilever) discloses liquid detergent compositions containing a dialkyl sulphosuccinate, an alkylbenzene sulphonate and an alkyl ether sulphate.

In the alkyl ether sulphate formula given above, $R_1$ is the alkyl residue of a primary aliphatic alcohol. Any given material will contain a range of chain lengths around a maximum: although the range of $C_{10}$–$C_{20}$ has been quoted, the content of materials at the extremes of this range will generally be very much smaller than the content of materials having chain-lengths in the middle of the range. GB No. 2 130 238A (Unilever) discloses the discovery that alkyl ether sulphates containing 20% or less of $C_{14}$ and above chain length material, and more particularly those containing substantially no $C_{14}$ and above chain length material, when used in combination with dialkyl sulphosuccinates exhibit exceptionally good foaming and detergency. "Narrow-cut" alkyl ether sulphates consisting entirely of $C_{12}$ and $C_{13}$ material, for example, Dobanol (Trade Mark) 23-3 and 23-2 ex Shell, both containing 50% each of $C_{12}$ and $C_{13}$ material (75% linear, 25% 2-methyl-branched), are especially preferred. GB No. 2 130 234A (Unilever) discloses combinations of the same preferred group of alkyl ether sulphates with a particular preferred group of alkylbenzene sulphonates in dishwashing liquids. These liquid compositions containing both optimised alkylbenzene sulphonate and optimised alkyl ether sulphate give substantially better foaming performance than compositions in which only one, or neither, of the components is optimised.

It has now been discovered that even greater foaming benefits may be obtained from the use of a particular selected subgroup of alkyl ether sulphates within the group disclosed in GB No. 2 136 238A and GB No. 2 136 234A, both in conjunction with dialkyl sulphosuccinates and with both optimised and non-optimised alkylbenzene sulphonates. Like the alkyl ether sulphates of GB No. 2 130 238A and GB No. 2 130 234A, those preferably used according to the present invention are essentially free of material of chain lengths other than $C_{12}$ and $C_{13}$.

The alkyl ether sulphates used in the compositions of the present invention are characterised by a particular branched-chain structure. The alkyl ether sulphates consist predominantly (50% by weight or more, preferably at least 55% by weight) of material branched at the 2-position, unlike the material of GB No. 2 130 238A and GB No. 2 130 234A which is predominantly linear. Furthermore, the type of branching is different: the materials used in the compositions of the present invention consists to an extent of at least 30% by weight of 2-ethyl or more highly branched material. This branching is characteristic of alcohols derived from random internal olefins. The preferred alkyl ether sulphates of GB No. 2 130 238A and GB No. 2 130 234A, on the other hand, are based on alcohols prepared from alpha-olefins. Alcohols produced commercially from alpha-olefins always contain less than 50% branching, and the branching present is almost entirely 2-methyl branching.

GB No. 1 504 843 (Kao Soap Co Ltd) discloses detergent compositions containing low-ethoxylate (0.5–1.5 EO) alkyl ether sulphates constituted by up to 70% of linear material and up to 30% of material branched at the 2-position. Fabric washing compositions displaying improved rinsability and containing alkyl ether sulphates having 23–72% branching are described. Examples 13 and 14 (comparative) disclose compositions containing alkylbenzene sulphonate and 36% branched alkyl ether (3EO or 5EO) sulphate in a 1:1 weight ratio: these compositions are said to have inferior rinsing properties to similar compositions containing the corresponding alkyl ether (1EO) sulphate. These 36% branched alkyl ether sulphates must be derived from alpha-olefins since they contain less than 50% branching. Although they have an average chain length of 12.4 carbon atoms, there is no indication that they are narrow-cut.

GB No. 738 538 (GAF Corporation) discloses detergent compositions containing highly branched alkyl ether sulphates of yet another type, derived from propylene tetramer. These are characterised by multiple methyl branching at random positions in the hydrocarbon chain, together with a low degree of ethyl branching, and are nowadays considered environmentally undesirable because of their lack of biodegradability.

The alkyl ether sulphates with which the present invention is concerned are distinguished from those of the prior art in that they are narrow-cut and are derived from internal olefins, combining a high level of branching at the 2-position with a high proportion of 2-ethyl or higher branching. At least 50% by weight of the alkyl ether sulphate material of the formula I, advantageously at least 55% by weight, is branched at the 2- or alpha-position, i.e. on the carbon atom adjacent to the terminal carbon atom carrying the head group; and at least 30% by weight of the formula I material, preferably at least 35% by weight, consists of material in which the alkyl chain carries at the 2-position an alkyl group of 2 or more carbon atoms. In other words, not more than 70% by weight, and preferably not more than 65% by weight, is linear or 2-methyl-branched.

ratios of 1:3 to 1:0.5, have been found to give significantly superior foaming as compared with corresponding compositions containing the predominantly linear material of GB No. 2 130 238A and GB No. 2 130 234A, even though there is no significant difference between the foaming powers of the two alkyl ether sulphates when they are used alone.

As previously indicated, the compositions of the invention contain a sulphonate-type anionic detergent selected from linear $C_8$–$C_{14}$ alkylbenzene sulphonates, $C_4$–$C_{10}$ dialkyl sulphosuccinates, and mixtures of the two.

Linear $C_8$–$C_{14}$ alkylbenzene sulphonates are exceedingly well-known detergent-active materials. Especially preferred are narrow-cut $C_{10}$–$C_{13}$ materials containing less than 5% by weight each of material having longer and shorter alkyl chains.

The chain length distribution and 2-phenyl isomer content of some commercially available alkylbenzenes or alkylbenzene sulphonates is shown in the following table:

| Material | Supplier | $C_{10}$ and below | $C_{11}$ | $C_{12}$ | $C_{13}$ | $C_{14}$+ | 2-phenyl isomer content |
|---|---|---|---|---|---|---|---|
| Dobane* 102 | Shell | 20 | 46 | 35 | — | — | 19 |
| Dobane* 113 | Shell | 12.5 | 38 | 31 | 18 | 0.5 | 17 |
| Dobane* 055 | Shell | 8 | 17 | 17 | 20 | 38 | 21 |
| Marlon* A | Huls | 4 | 44 | 40 | 11 | — | 20 |
| Ucane* 11 | Union Carbide | 11 | 38 | 40 | 8 | 1 | 30 |
| Dodane* S | Witco | 13 | 43 | 37 | 7 | 1 | 30 |
| Nalkylene*500 | Conoco | 14 | 40 | 35 | 9 | 2 | 30 |
| Sirene*X12L | SIR | 7 | 30 | 34 | 25 | 3 | 38 |
| Korenyl*Neu | Texaco/DEA | 8 | 36 | 35 | 20 | 1 | 37 |

*Denotes Trade Mark.

A preferred alkyl ether sulphate for use in the compositions of the present invention is Lialet (Trade Mark) 123 manufactured by Chimica Augusta, Italy. This consists of 43±5% by weight of $C_{12}$ material and 57±5% by weight of $C_{13}$ material, and not more than 1% by weight each of $C_{11}$ and shorter-chain, and $C_{14}$ and longer-chain, material. It contains approximately 40% by weight of linear material; about 40% by weight of 2-ethyl or more highly branched material; and about 20% by weight of 2-methyl branched material.

The isomer distribution of a typical sample (as starting alcohol) is given below:

| | Weight % |
|---|---|
| $C_{12}$ material | |
| 2-pentyl-1-heptanol | 6.7 |
| 2-butyl-1-octanol | |
| 2-propyl-1-nonanol | 4.0 |
| 2-ethyl-1-decanol | 3.7 |
| 2-methyl-1-undecanol | 7.0 |
| 1-dodecanol | 20.3 |
| $C_{13}$ material | |
| 2-pentyl-1-octanol | 8.9 |
| 2-butyl-1-nonanol | 6.5 |
| 2-propyl-1-decanol | 6.3 |
| 2-ethyl-1-undecanol | 5.4 |
| 2-methyl-1-dodecanol | 9.7 |
| 1-tridecanol | 21.2 |

This material is available as 2 EO, 3 EO, 4 EO and 7 EO ether sulphates. As will be demonstrated in more detail in the Examples below, compositions containing this alkyl ether sulphate in conjunction with dialkyl sulphosuccinates or with alkylbenzene sulphonates, at Of these materials, Dobane 055 is the least preferred on account of its high content of $C_{14}$ and longer-chain material.

The optimised group of alkylbenzene sulphonates identified in GB No. 2 130 234A (Unilever), mentioned previously, consists of narrow-cut $C_{10}$–$C_{13}$ linear alkylbenzene sulphonates, as defined above, having a $C_{13}$ content not exceeding 15% by weight of the 2-phenyl isomer content is 30% by weight or more, or not exceeding 30% by weight (preferably not exceeding 15% by weight) if the 2-phenyl isomer content is less than 30% by weight. Of the materials listed above, Dobane 102, Marlon A, Ucane 11, Dodane S and Nalkylene 500 fall within this group. Sirene X12L, and Korenyl Neu are outside this group because of their high $C_{13}$ content and high 2-phenyl isomer content.

Surprisingly, the foaming benefit of the present invention is even greater with alkylbenzene sulphonates of high $C_{13}$ content and high 2-phenyl isomer content, such as Sirene X12L, than with the group of alkylbenzene sulphonates identified as optimum in GB No. 2 130 234A. Thus use of the specified branched alkyl ether sulphate in accordance with the present invention allows a wide range of alkylbenzene sulphonates to be employed in foaming detergent compositions without loss of foaming performance.

The countercation of the alkylbenzene sulphonate used according to the present invention may, as with the alkyl ether sulphate, be any solubilizing cation. Sodium, ammonium, ethanolamine and magnesium are especially preferred.

The other class of sulphonate-type anionic detergents that may be incorporated in the compositions of the present invention is constituted by the detergent-active salts of dialkyl esters of sulphosuccinic acid, referred to for convenience as dialkyl sulphosuccinates. These are compounds of the formula II:

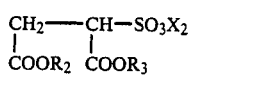

$$\begin{array}{l} CH_2 — CH — SO_3X_2 \\ \quad | \qquad\quad | \\ COOR_2 \quad COOR_3 \end{array} \qquad (II)$$

wherein each of $R_2$ and $R_3$, which may be the same or different, represents a straight-chain or branched-chain alkyl group having from 4 to 10 carbon atoms, advantageously from 6 to 8 carbon atoms, and $X_2$ represents a solubilising cation.

The dialkyl sulphosuccinate component of the dishwashing composition of the invention may if desired be constituted by a mixture of materials of different chain lengths, of which the individual dialkyl sulphosuccinates themselves may be either symmetrical (both alkyl groups the same) or unsymmetrical (with two different alkyl groups).

The alkyl groups $R_2$ and $R_3$ are preferably straight-chain or (in mixtures) predominantly straight-chain.

Among dialkyl sulphosuccinates that may advantageously be used in the compositions of the invention are the $C_6/C_8$ unsymmetrical materials described and claimed in GB No. 2 150 325B (Unilever); the dioctyl sulphosuccinate/dihexyl sulphosuccinate mixtures described and claimed in GB No. 2 104 913B (Unilever); the mixtures of symmetrical and unsymmetrical dialkyl sulphosuccinates described and claimed in GB No. 2 108 520B (Unilever); and the $C_7/C_8$ and $C_6/C_7/C_8$ dialkyl sulphosuccinate mixtures described and claimed in GB No. 2 133 793A (Unilever).

One dialkyl sulphosuccinate system of especial interest is a mixture containing $diC_6$, $diC_8$ and $C_6/C_8$ material. Such a mixture may be prepared, as described in the aforementioned GB No. 2 108 520B, by reacting a mixture of n-hexanol and n-octanol with maleic anhydride and subjecting the resulting mixture of dialkyl maleates/fumarates to bisulphite addition. If the starting alcohols are used in substantially equimolar proportions, a so-called "statistical mixture" is obtained which contains the $diC_6k$, $diC_8$ and $C_6/C_8$ sulphosuccinates in molar proportions of approximately 1:1:2.

In the composition of the invention, the weight ratio of component (a) (alkylbenzene sulphonate and/or dialkyl sulphosuccinate) to component (b) (alkyl ether sulphate) ranges from 3:1 to 0.5:1, preferably from 2.5:1 to 1:1 and more preferably from 2:1 to 1:1. However, most preferably is a ratio which ranges from 2:1 to 0.5:1. At wider ratios correspondingly smaller benefits are obtained. It would appear that the improved foaming characteristic of the invention originates from some interaction between the components (a) and (b) which necessitates their being present in amounts which are not too dissimilar.

Additional detergent-active materials may be present in the compositions of the invention provided that alkyl ether sulphates other than those specified under (b) above are absent, and that the specified components (a) and (b) together predominate over the total of any other detergent-active materials present.

For example, the component (a)—alkylbenzene sulphonate and/or dialkyl sulphosuccinate—may be supplemented or partially replaced by another sulphonate-type anionic detergent, for example, a secondary alkane sulphonate, or by a primary or secondary alkyl sulphate, provided that the component (a) predominates over the other detergent. The foaming benefit characteristic of the invention has not been observed to a significant extent with combinations of the specified alkyl ether sulphates with secondary alkane sulphonates, so these detergents cannot wholly replace the alkylbenzene sulphonate and/or dialkyl sulphosuccinate.

As indicated above, primary alkyl sulphates may be included in the compositions of the invention. These are materials of the formula III

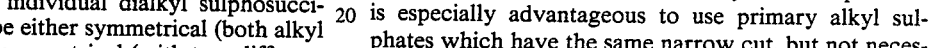

$$R_4—O—SO_3X_3 \qquad (III)$$

wherein $R_4$ is a $C_{10}$–$C_{20}$ alkyl group and $X_3$ is a solubilising cation which may be the same as or different from $X_1$, the solubilising cation of the alkyl ether sulphate. It is especially advantageous to use primary alkyl sulphates which have the same narrow cut, but not necessarily the same branching pattern, as the alkyl ether sulphates.

Thus the primary alkyl sulphate Lial (Trade Mark) 123, ex Chimica Augusta, which is derived from the same alcohol mix as Lialet 123 ether sulphate mentioned above, may with advantage be included within compositions of the invention that contain Lialet 123; but Dobanol 23, derived from the same alcohol mix as the Dobanol 23-2 and 23-3 ether sulphates referred to in GB No. 2 130 238A and GB No. 2 130 234A, is also advantageously used in compositions according to the present invention. The inclusion of other alkyl sulphates is also within the scope of the invention.

Accordingly, the compositions of the invention may contain a primary alkyl sulphate, which is advantageously matched to the alkyl ether sulphate in chain length distribution. The amount of alkyl sulphate present must not exceed the amount of the sulphonate-type anionic detergent (a).

The alkyl ether sulphate (b) may if desired be supplemented or partially replaced by nonionic detergents, which may be ethoxylated or non-ethoxylated. Both types may be present together.

Preferred ethoxylated nonionic detergents are the ethoxylated alcohols and alkyl phenols of the general formula IV

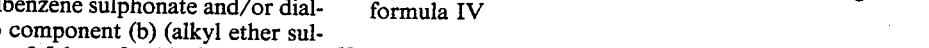

$$R_5—(C_6H_4)_x—(OCH_2CH_2)_m—OH \qquad (IV)$$

wherein x is zero (alcohol ethoxylates) or 1 (alkylphenol ethoxylates); $R_5$ is an alkyl group having from 6 to 20 carbon atoms; and m, the average degree of ethoxylation, ranges from 5 to 30. For alcohol ethoxylates, $R_5$ preferably has from 8 to 18, more preferably from 8 to 13, carbon atoms, and m is from 5 to 14. For alkylphenol ethoxylates, $R_5$ preferably has from 8 to 12 carbon atoms and m is from 8 to 16.

These materials may be present in the compositions of the invention in amounts not exceeding the amount of the alkyl ether sulphate (b).

Also advantageously is the presence of a minor amount of a $C_{10}$–$C_{20}$ carboxylic acid mono- or di($C_2$–$C_3$) alkanolamide, especially a $C_{10}$–$C_{20}$ mono- or diethanolamide. These are materials of the general formula V

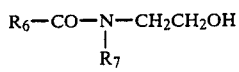

(V)

wherein $R_6$ is $C_{10}$–$C_{20}$ alkyl group, and $R_7$ is H or $CH_2CH_2OH$. Both mono- and diethanolamides are useful in compositions in which component (a) is an alkylbenzene sulphonate, for improving soft water performance. Diethanolamides are especially beneficial in compositions in which component (a) is a dialkyl sulphosuccinate. Compositions containing dialkyl sulphosuccinates, alkyl ether sulphates and $C_{10}$–$C_{18}$ carboxylic acid di($C_2$–$C_3$) alkanolamides are disclosed in GB No. 2 130 236A (Unilever).

Mono- and diethanolamides may be included in the compositions of the invention in amounts not exceeding the amount of alkyl ether sulphate (b) present. It is also preferred that not more than 25% by weight of the total detergent-active material present be constituted by mono- or dialkanolamides.

As indicated previously, the detergent compositions of the invention may take any suitable physical form, for example, powders, bars, liquids or gels, and may contain from 2 to 95% by weight, in total, of active detergent. Compositions in aqueous liquid or gel form, containing a total of from 2 to 80% by weight of active detergent, are of especial interest. Unbuilt liquid or gel products for light-duty applications, notably hand dishwashing, constitute a preferred embodiment of the invention. These may also be used for other detergent purposes where foaming is advantageous, for example, fabric washing products, general purpose domestic and industrial cleaning compositions, carpet shampoos, or car wash products.

As well as active detergents and water, liquid detergent compositions of the invention will generally need to contain one or more hydrotropes. These are materials present in a formulation to control solubility, viscosity, clarity and stability, but which themselves make no active contribution to the performance of the product. Examples of hydrotropes include lower aliphatic alcohols, especially ethanol; urea; lower alkylbenzene sulphonates such as sodium toluene or xylene sulphonates; and combinations of these. Hydrotropes should be used in the minimum possible quantities consistent with good formulation properties over a wide temperature range.

All compositions of the invention may of course also contain the usual minor ingredients such as perfume, colour, preservatives and germicides.

The invention is further illustrated by the following non-limiting Examples, in which parts and percentages are by weight unless otherwise stated.

EXAMPLES 1 AND 2

The foaming performances of mixtures of alkylbenzene sulphonates at a ratio of about 2:1 with two different ether sulphates (one according to the invention, the other not) were compared at a total product dosage of 1.0 g/liter in hard (24°H) water. The comparison was carried out by means of a plate washing test. In the test, plates soiled with a standard starch/fat/fatty acid mixture were washed in a standard manner with 5 liters of test solution at 45° C. in a bowl, until only a third of the surface of the solution in the bowl was covered with foam. The number of plates washed before this arbitrary end-point was reached was taken as an indicator of dishwashing and foaming performance.

The alkylbenzene sulphonates were Dobane 102 ex Shell and Marlon A ex Hüls, details of which have been given previously. The alkyl ether sulphate according to the invention was Lialet 123, 3 EO, sodium salt, while the comparative material was Dobanol 23-3A (3 EO, ammonium salt) ex Shell: details of both materials have been given previously. The results are shown below: the comparative mix A was in accordance with GB No. 2 130 234A (Unilever) mentioned above.

| | A | 1 | B | 2 |
|---|---|---|---|---|
| Dobane 102 | 27 | 27 | — | — |
| Marlon A | — | — | 27 | 27 |
| Dobanol 23-3A | 13 | — | 13 | — |
| Lialet 123-3S | — | 13 | — | 13 |
| Plates test, | | | | |
| 24° H. | 34 | 39 | 27 | 33 |
| 5° H. | — | — | 39 | 42 |

It will be seen that in each case the use of Lialet 123-3S gave a significantly better plates score.

Compositions B and 2 were also compared with respect to foam profile during the plate washing test. In this variant of the plate washing test, the initial foam height of the test solution, then the foam heights after washing the first, third, sixth and every subsequent third plate up to a total of 18, were recorded and then summed. The results are shown below.

| Foam height sum (mm) | B | 2 |
|---|---|---|
| 24° H. | 131 | 149 |
| 5° H. | 140 | 178 |

EXAMPLES 3 AND 4

Plates tests (the first-described version) at a higher concentration of 1.5 g/liter were carried out on Dobane 102/alkyl ether sulphate compositions at ratios of about 0.5:1, 1:1, about 2:1, 4:1, and about 6:1. Again the comparative mixes were in accordance with GB No. 2 130 234A (Unilever). The results are shown in the relevant Table. It will be seen that the greatest benefit was obtained at a ratio of 1:1 (Composition 4), and a significant benefit was also obtained at 2:1 (Composition 1). At all ratios the performance was at least as good with Lialet 123-3S as with Dobanol 23-3A, but there was no significant benefit at the 4:1 and about 6:1 ratios.

EXAMPLES 5 TO 7

The procedure of Examples 3 and 4 was repeated using a different alkylbenzene sulphonate, Sirene X12L (mentioned previously). The results are shown in the relevant Table. It will be noted that again the greatest benefit was observed at ratios of 2:1 and 1:1, and the benefit was greater with this alkylbenzene sulphonate of high $C_{13}$ content and a high 2-phenyl isomer content than with the Dobane 102 of Examples 3 and 4 which has lower $C_{13}$ and 2-phenyl isomer contents.

| | EXAMPLES 3 and 4 | | | | | | | | | |
|---|---|---|---|---|---|---|---|---|---|---|
| | C | 3 | D | 4 | A | 1 | E | F | G | H |
| Dobane 102 | 13 | 13 | 20 | 20 | 27 | 27 | 32 | 32 | 34 | 34 |
| Dobanol 23-3A | 27 | — | 20 | — | 13 | — | 8 | — | 6 | — |
| Lialet 123-3S | — | 27 | — | 20 | — | 13 | — | 8 | — | 6 |
| Plates test, 24° H. | 42 | 42 | 46 | 51 | 45 | 49 | 44 | 44 | 39 | 41 |

| EXAMPLES 5 to 7 | J | 5 | K | 6 | L | 7 | M | N | P | Q |
|---|---|---|---|---|---|---|---|---|---|---|
| Sirene X12L | 13 | 13 | 20 | 20 | 27 | 27 | 32 | 32 | 34 | 34 |
| Dobanol 23-3A | 27 | — | 20 | — | 13 | — | 8 | — | 6 | — |
| Lialet 123-3S | — | 27 | — | 20 | — | 13 | — | 8 | — | 6 |
| Plates test, 24° H. | 38 | 39 | 40 | 47 | 41 | 51 | 41 | 40 | 34 | 34 |

EXAMPLE 8

A further plates test comparison, at 1.0 g/liter, was carried out using Marlon A and alkyl ether sulphate at a ratio of 1.67:1. The results were as follows:

| | R | 8 |
|---|---|---|
| Marlon A | 25 | 25 |
| Dobanol 23-3A | 15 | — |
| Lialet 123-3S | — | 15 |
| Plates test, 24° H. | 31 | 35 |
| Plates test, 5° H. | 39 | 45 |

Composition 8 according to the invention was substantially better than Comparative Composition S in both hard and soft water.

EXAMPLES 9 TO 11

Further comparisons were carred out using a different test, showing foam persistence in the presence of added soil, based on the principle described in *Fette and Seifen* 1951, 53, 207. A 100 ml aqueous solution of each material tested, having a concentration of 1 g/liter of the total product, in 5°H or 24°H water at 45° C., was rapidly oscillated using a vertically oscillating perforated disc within a graduated cylinder. After the initial generation of foam, increments (0.2 g) of soil (9.5 parts commercial cooking fat, 0.25 parts oleic acid, 0.25 parts stearic acid and 10 parts wheat starch in 120 parts water) were added at 15-second intervals (10 seconds' mild agitation and 5 seconds' rest) until the foam collapsed. The result was recorded as the number of soil increments (NSI score). Each result was the average of two runs.

These tests, using the alkylbenzene sulphonates Marlon A (identified previously) and Dobane (Trade Mark) 113 ex Shell, a slightly longer-chain material, were carried out at the ratios of 2:1 and 1:1 already shown in Examples 3 to 8 to be the most effective. The results are shown in the relevant Table: each is an average of two runs. In each case the numbered compositions according to the invention performed significantly better than the lettered comparative compositions.

| EXAMPLES 9 to 11 | B | 2 | S | 9 | T | 10 | U | 11 |
|---|---|---|---|---|---|---|---|---|
| Marlon A | 27 | 27 | 20 | 20 | — | — | — | — |
| Dobane 113 | — | — | — | — | 27 | 27 | 20 | 20 |
| Dobanol 23-3A | 13 | — | 20 | — | 13 | — | 20 | — |
| Lialet 123-3S | — | 13 | — | 20 | — | 13 | — | 20 |
| NSI score, 24° H. | 41.5 | 47.5 | 41.5 | 45 | 45 | 51 | 49 | 52.5 |

COMPARATIVE EXAMPLES V TO Y

A similar set of NSI score comparisons was conducted using a secondary alkane sulphonate, SAS 60 ex Hoechst, instead of an alkylbenzene sulphonate. At a 2:1 ratio only a very small difference in favour of Lialet 123-3S could be observed, and at a 1:1 ratio a small difference in the opposite direction was noted.

| | V | W | X | Y |
|---|---|---|---|---|
| SAS 60 | 27 | 27 | 20 | 20 |
| Dobanol 23-3A | 13 | — | 20 | — |
| Lialet 123-3S | — | 13 | — | 20 |
| NSI score, 24° H. | 40 | 42.5 | 42 | 41 |

Thus the use of Lialet 123-3S appears to offer no significant benefit in conjunction with a secondary alkane sulphonate.

EXAMPLES 12 AND 13

Plates test comparisons at 1.0 g/liter were carried out on compositions containing the alkylbenzene sulphonate Marlon A and alkyl ether sulphate, at ratios of 1:1 and 0.5:1. One pair of compositions also contained an ethoxylated nonionic detergent (Dobanol (Trade Mark) 91-8 ex Shell: ethoxylated (8EO) $C_9$–$C_{11}$ alcohol) and lauric diethanolamide. The other pair of compositions contained secondary alkane sulphonate, in equal amounts with the alkylbenzene sulphonate. The results are shown in the relevant Table. A small benefit from the use of Lialet 123-3S was apparent in the presence of the nonionic detergents, but the presence of substantial levels of secondary alkane sulphonate apparently cancelled any such benefit out.

| EXAMPLES 12 and 13 | Z | 12 | AA | 13 |
|---|---|---|---|---|
| Marlon A | 12 | 12 | 10 | 10 |
| SAS 60 | — | — | 10 | 10 |
| Dobanol 23-3A | 18 | — | 20 | — |
| Lialet 123-3S | — | 18 | — | 20 |
| Dobanol 91-8 | 6 | 6 | — | — |
| Lauric diethanolamide | 4 | 4 | — | — |
| Plates test, 24° H. | 30 | 32 | 34 | 34 |

EXAMPLES 14 AND 15

Compositions containing alkylbenzene sulphonate (Dobane 102) and alkyl ether sulphate, at ratios of 1.5:1 and 0.7:1, together with primary alkyl sulphate, were compared using the NSI test at 1.0 g/liter. The primary alkyl sulphate was Dobanol (Trade Mark) 23A ex Shell, corresponding to Dobanol 23-3A and therefore not matched to the Lialet 123-3S. Nevertheless, a substantial foaming benefit was observed when Lialet 123-3S was used.

| | BB | 14 | CC | 15 |
|---|---|---|---|---|
| Dobane 102 | 20 | 20 | 14 | 14 |
| Dobanol 23A | 7 | 7 | 6 | 6 |
| Dobanol 23-3A | 13 | — | 20 | — |
| Lialet 123-3S | — | 13 | — | 20 |
| NSI score, 24° H. | 40 | 46.5 | 39.5 | 44 |

Examples 14 and 15 were repeated using the primary alkyl sulphate Lial 123-S matched to the Lialet 123, instead of Dobanol 23A, but no further improvement was observed.

EXAMPLES 16 TO 18

This experiment shows the foaming performance, as measured by the plates test at 3.5 g/liter, of some further compositions containing alkylbenzene sulphonate (Dobane 102) and Lialet 123-3S.

| | 16 | 17 | 18 |
|---|---|---|---|
| Dobane 102 | 27 | 22 | 20.4 |
| Lialet 123-3S | 13 | 13 | 12.0 |
| Lial 123-S | — | 5 | 4.6 |
| Coconut diethanolamide | — | — | 3.0 |
| Magnesium sulphate | 2.5 | 2.5 | 2.5 |
| Plates test | | | |
| 24° H. | 46 | 48.5 | 49 |
| 5° H. | 42 | 41 | 43.5 |

All three compositions contained magnesium sulphate to improve soft water performance.

Comparison of Example 17 with Example 16 shows the effect of partially replacing the alkylbenzene sulphonate by the primary alkyl sulphate Lial 123-S mentioned previously: there was a small improvement in hard water performance, at the cost of a smaller deterioration of soft water performance. In Composition 18 coconut diethanolamide was present, partially replacing all three of the anionic detergents used in Composition 17, and gave a small improvement at both water hardnesses.

EXAMPLES 19 TO 21

The foaming performances of various mixtures of dialkyl sulphosuccinates and alkyl ether sulphates were compared using the plates test at 1.0 g/liter. Dialkyl sulphosuccinates containing different proportions of $C_6$, $C_7$ and $C_8$ material were used, as shown below. These were prepared by the methods described in GB No. 2 108 520B (Unilever), Example 1, and in GB No. 2 130 235B (Unilever); the proportions shown are molar proportions of the starting alcohols in the mixture reacted with maleic anhydride. The dialkyl sulphosuccinate to alkyl ether sulphate ratios were 2:1 and 1.4:1. The lauric diethanolamide was Empilan (Trade Mark) LDE ex Albright & Wilson.

The results are shown in the following Table.

| | DD | 19 | EE | 20 | FF | 21 |
|---|---|---|---|---|---|---|
| Dialkyl sulphosuccinate: | | | | | | |
| $C_6/C_8$ (40:60) | 16 | 16 | — | — | — | — |
| $C_7/C_8$ (60:40) | — | — | 14 | 14 | — | — |
| $C_6/C_7/C_8$ (20:40:40) | — | — | — | — | 18 | 18 |
| Dobanol 23-3A | 8 | — | 10 | — | 9 | — |
| Lialet 123-3S | — | 8 | — | 10 | — | 9 |
| Lauric diethanolamide | — | — | 3 | 3 | — | |
| Plates test, 1 g/liter | | | | | | |
| 24° H. | 26 | 28 | 29 | 34 | 35 | 38 |
| 5° H. | — | — | 37 | 44 | 43 | 45 |

EXAMPLE 22

Some more dilute compositions were compared similarly using higher product dosages and different water hardness, as follows:

| | GG | 22 |
|---|---|---|
| Dialkyl sulphosuccinate: | | |
| $C_6/C_8$ (50:50) | 10 | 10 |
| Dobanol 23-3A | 5 | — |
| Lialet 123-3S | — | 5 |
| Plates test, 3 g/liter | | |
| 6° H. | 22 | 28 |
| 18° H. | 26 | 31 |

-continued

| | GG | 22 |
|---|---|---|
| Plates test, 5 g/liter | | |
| 6° H. | 37 | 48 |

EXAMPLES 23 & 24

Some more concentrated compositions containing dialkyl sulphosuccinate ($C_7/C_8$, 50:50) were compared using the NSI test described previously, at a product dosage of 0.5 g/liter, in 24°H in water. The results were as follows:

| | HH | 23 | JJ | 24 |
|---|---|---|---|---|
| Dialkyl sulphosuccinate: | | | | |
| $C_7/C_8$ (50:50) | 27 | 27 | 20 | 20 |
| Dobanol 23-3A | 13 | — | 20 | — |
| Lialet 123-3S | — | 13 | — | 20 |
| NSI score, 24° H. | 33.5 | 41.5 | 34.5 | 40.5 |

The substantial difference, even at the low dosage of 0.5 g/liter, will be noted.

COMPARATIVE EXAMPLES KK TO NN

Compositions containing alkyl ether sulphate (predominant) with coconut monoethanolamide (Empilan (Trade Mark) CME ex Albright & Wilson) or amine oxide (Ammonyx (Trade Mark) LO ex Onyx Chemical Company) were compared using the plates test at 1.0 g/liter. None of these compositions contained alkylbenzene sulphonate or dialkyl sulphosuccinate, and no benefit was observed from the use of Lialet 123-3S.

| | KK | LL | MM | NN |
|---|---|---|---|---|
| Dobanol 23-3A | 32 | — | 32 | — |
| Lialet 123-3S | — | 32 | — | 32 |
| Coconut monoethanolamide | 8 | 8 | — | — |
| Ammonyx LO | — | — | 8 | 8 |
| Plates test, 24° H. | 23 | 23 | 28 | 28 |

EXAMPLES 25 TO 27

Previous Examples have all been concerned with foaming performance, and have employed diluted samples (1.0 g/liter or 1.5 g/liter) in which only the relative proportions of the various constituents, not their absolute concentrations, were significant.

In this experiment some fully formulated, hydrotroped liquid detergent compositions were prepared and their physical properties were compared. The cloud point is a measure of low-temperature stability and denotes the temperature at which turbidity due to phase separation is first observed when the sample is cooled.

The compositions according to the invention (25,26,27) had slightly, but not significantly, better low-temperature stability than the comparative compositions (QQ,RR,SS). The main advantage observed was in the viscosity at ambient temperature, which tended to be too high for the comparative compositions but was stable around the desirable 300 mPas region for the compositions according to the invention.

| | EXAMPLES 25 to 27 | | | | | |
|---|---|---|---|---|---|---|
| | PP | 25 | QQ | 26 | RR | 27 |
| Total active detergent | 21 | 21 | 30 | 30 | 35 | 35 |
| Ratio (a):(b) | 1.5:1 | 2.5:1 | 2:1 | 2:1 | 2:1 | 2:1 |
| Dobanol 102 | 14 | 14 | 20 | 20 | 23.6 | 23.6 |
| Dobanol 23-3A | 7 | — | 10 | — | 11.4 | — |
| Lialet 123-3A | — | 7 | — | 10 | — | 11.4 |
| Urea | — | — | 3 | 3 | 6 | 6 |
| Ethanol | 1.8 | 1.8 | 3.6 | 3.6 | 4.8 | 4.8 |
| Cloud point (°C.) | +1 | +1 | <−3 | −2 | <−6 | <−4 |
| Viscosity (mPas) | 288 | 200 | 432 | 320 | 544 | 280 |

EXAMPLE 28

A concentrated (62% active detergent) composition was prepared from the following ingredients:

| | |
|---|---|
| Dialkyl sulphosuccinate ($C_6/C_8$, 50:50) | 36 |
| Lialet 123-3S | 12 |
| Dobanol 91-8 | 6 |
| Lauric diethanolamide | 8 |
| Ethanol | 14 |

This was a clear stable liquid at ambient temperature and had a cloud point of 13° C.

EXAMPLES 29-32

The NSI test described in Examples 9 to 11 was carried out at 1.0 g/l of product for compositions of the invention containing Dobane 102 and alkyl ether sulphates (based on Lialet 123) of ethoxylation number varying from 2 to 7, and for comparative compositions were the alkyl ether sulphates (based on Dobanol 23) had ethoxylation numbers varying from 2 to 6.5. In the Table, the EO numbers are given in brackets. A clear benefit of the invention appears at all ethoxylation numbers, though it is less at high EO. In those tests, as in following Examples 33-38 and the corresponding comparative examples, the NSI scores are the average of four runs. In all these examples also, the Lialet 123 is the sodium salt, and the Dobanol 23 is the ammonium salt.

| | Examples 29-32 | | | | | | | |
|---|---|---|---|---|---|---|---|---|
| | SS | 29 | TT | 30 | UU | 31 | VV | 32 |
| Dobane 102 | 20 | 20 | 20 | 20 | 20 | 20 | 20 | 20 |
| Dobanol 23 (EO No.) | 20(2) | — | 20(3) | — | 20(4) | — | 20(6.5) | — |
| Lialet 123 (EO No.) | — | 20(2) | — | 20(3) | — | 20(4) | — | 20(7) |
| NSI score, 24° H. | 47 | 57 | 45 | 53 | 41.5 | 50 | 40.5 | 42.5 |

EXAMPLES 33-36

Examples 29-32 and the comparative examples were repeated with dialkylsulphosuccinate $C_6/C_8$ (40:60) instead of Dobane 102. Again improvement is shown over the whole ethoxylation number range tested. The total active detergent concentration was lower, and the component ratio different.

| | EXAMPLES 33-36 | | | | | | | |
|---|---|---|---|---|---|---|---|---|
| | WW | 33 | XX | 34 | YY | 35 | ZZ | 36 |
| Dialkyl sulphosuccinate | 16 | 16 | 16 | 16 | 16 | 16 | 16 | 16 |
| Dobanol 23 (EO No.) | 8(2) | — | 8(3) | — | 8(4) | — | 8(6.5) | — |
| Lialet 123 (EO No.) | — | 8(2) | — | 8(3) | — | 8(4) | — | 8(7) |
| NSI score, 24° H. | 35 | 38.5 | 40 | 46.5 | 41 | 49 | 43 | 44 |

EXAMPLES 37-38

Example 34 was reated, at two other ratios of dialkylsulphosuccinate to alkyl ether sulphate, showing that the improvement of the invention extends to ratios of active components down to 0.5:1.

| | AAA | 37 | BBB | 38 |
|---|---|---|---|---|
| Dialkyl sulphosuccinate | 8 | 8 | 12 | 12 |
| Dobanol 23-3A | 16 | — | 12 | — |
| Lialet 123-3S | — | 16 | — | 12 |
| NSI score, 24° H. | 25.5 | 34 | 38 | 45 |

What is claimed is:

1. A foaming detergent composition comprising from 2 to 95% by weight of an active detergent system consisting essentially of:

(a) a linear $C_8$–$C_{14}$ alkylbenzene sulphonate and/or a $C_4$–$C_{10}$ dialkyl sulphosuccinate, and (b) an alkyl ether sulphate of the formula I $$R_1—O—(CH_2CH_2O)_n—SO_3X_1 \quad (I)$$

wherein $R_1$ is an alkyl group, the average degree of ethoxylation n is from 2 to 7 and $X_1$ is a solubilising cation, the alkyl ether sulphate of the formula I consisting substantially wholly of material in which the group $R_1$ has 12 to 13 carbon atoms, and comprising at least 55% by weight of material in which the group $R_1$ is branched at the 2-position, and comprising at least 35% by weight of material in which the group $R_1$ carries at the 2-position an alkyl group containing 2 or more carbon atoms, the weight ratio of (a) to (b) being within the range of from 2:1 to 0.5:1.

2. A detergent composition as claimed in claim 1, wherein the anionic detergent (a) comprises a linear $C_{10}$–$C_{13}$ alkylbenzene sulphonate.

3. A detergent composition as claimed in claim 1, wherein the anionic detergent (a) comprises a $C_6$–$C_8$ dialkyl sulphosuccinate in which the alkyl groups may be the same or different.

4. A detergent composition as claimed in claim 1, wherein the active detergent system further comprises (c) a primary alkyl sulphate of the formula III $$R_4—O—SO_3X_3 \quad (III)$$

wherein $R_4$ is a $C_{10}$–$C_{20}$ alkyl group and $X_3$ is a solubilising cation which may be the same as or different from $X_1$, the amount of component (c) present not exceeding the amount of component (a) present.

5. A detergent composition as claimed in claim 1, wherein the active detergent system further comprises (d) an ethoxylated alcohol or alkylphenol of the formula IV $$R_5—(C_6H_4)_x—(OCH_2CH_2)_m—OH \quad (IV)$$

wherein x is zero or 1, $R_5$ is a $C_6$–$C_{20}$ alkyl group and m is within the range of from 5 to 30, the amount of component (d) present not exceeding the amount of component (b) present.

6. A detergent composition as claimed in claim 1, wherein component (a) is a linear $C_8$–$C_{14}$ alkylbenzene sulphonate and the active detergent system further comprises an alkyl mono- or diethanolamide of the formula V $$R_6—CO—\underset{\underset{R_7}{|}}{N}—CH_2CH_2OH \quad (V)$$

wherein $R_6$ is a $C_{10}$–$C_{20}$ alkyl group, and $R_7$ is H or $CH_2CH_2OH$, the amount of mono- or diethanolamide present not exceeding the amount of component (b) present and not exceeding 25% by weight of the total active detergent system.

7. A detergent composition as claimed in claim 1, wherein component (a) is a $C_4$–$C_{10}$ dialkyl sulphosuccinate and the active detergent system further comprises an alkyl diethanolamide of the formula VI $$R_8—CO—N(CH_2CH_2OH)_2 \quad (VI)$$

wherein $R_8$ is a $C_{10}$–$C_{20}$ alkyl group, the amount of diethanolamide present not exceeding the amount of component (b) present and not exceeding 25% by weight of the total active detergent system.

8. A detergent composition as claimed in claim 1, wherein the weight ratio of component (a) to component (b) is from 2:1 to 1:1.

9. A detergent composition as claimed in claim 1, which comprises an aqueous liquid or gel having a total active detergent content within the range of from 2 to 80% by weight.

* * * * *